US009008569B2

(12) United States Patent
Morita

(10) Patent No.: US 9,008,569 B2
(45) Date of Patent: Apr. 14, 2015

(54) IMAGE FORMING SYSTEM HAVING FUNCTION TO PERMIT STAPLE PROCESSING FOR JOB INCLUDING SMALL SIZE SHEET BASED ON PAGE POSITION OF SMALL SIZE SHEET IN A JOB, AND IMAGE FORMING METHOD FOR THE SAME

(71) Applicant: Konica Minolta, Inc., Chiyoda-ku, Tokyo (JP)

(72) Inventor: Keisuke Morita, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 94 days.

(21) Appl. No.: 13/860,499

(22) Filed: Apr. 10, 2013

(65) Prior Publication Data

US 2013/0272741 A1 Oct. 17, 2013

(30) Foreign Application Priority Data

Apr. 16, 2012 (JP) ..... 2012-093424

(51) Int. Cl.
*G03G 15/00* (2006.01)

(52) U.S. Cl.
CPC ..... *G03G 15/6582* (2013.01); *G03G 15/507* (2013.01); *G03G 15/6538* (2013.01)

(58) Field of Classification Search
CPC ..... G03G 15/6538; G03G 15/6541; G03G 2215/00822; G03G 15/6544; G03G 2215/00827; G03G 2215/00734
USPC ..... 399/45, 82, 407–410
See application file for complete search history.

(56) References Cited

U.S. PATENT DOCUMENTS

| | | | | |
|---|---|---|---|---|
| 6,711,365 | B2 * | 3/2004 | Ohtani | 399/82 |
| 7,817,931 | B2 | 10/2010 | Takeuchi | |
| 2001/0016124 | A1 * | 8/2001 | Shiramura | 399/82 |
| 2006/0127122 | A1 * | 6/2006 | Arai | 399/82 |

FOREIGN PATENT DOCUMENTS

| | | | |
|---|---|---|---|
| EP | 1366921 | A1 * | 12/2003 |
| JP | 2004-045650 | A | 2/2004 |
| JP | 2008-094615 | A | 4/2008 |
| JP | 2009-234749 | A | 10/2009 |
| JP | 2009-234750 | A | 10/2009 |
| JP | 2010-228835 | A | 10/2010 |

OTHER PUBLICATIONS

Japanese Office Action dated Apr. 16, 2014 (and English translation thereof) in counterpart Japanese Application No. 2012-093424.

* cited by examiner

*Primary Examiner* — Robert Beatty
(74) *Attorney, Agent, or Firm* — Holtz, Holtz, Goodman & Chick PC

(57) ABSTRACT

An image forming system includes an image forming unit to print an image on a sheet based on a job, a postprocessing unit to carry out postprocessing to the sheet based on the job, and a control unit to manage the job, and to control the print and the postprocessing, the control unit can determine whether the postprocessing execution job includes an applying prohibition sheet or not, and if a predetermined condition such as a page other than first and last pages is satisfied in predetermined postprocessing such as bundle processing, permits the job for the predetermined postprocessing to carry out an output such as insertion of the applying prohibition sheet, for which the postprocessing is prohibited in applying due to a difference in sheet size from a prescribed size and the like, into a bundle of applying permission sheets.

6 Claims, 8 Drawing Sheets

FIG.3

| | | | |
|---|---|---|---|
| JOB DATA | | NUMBER OF COPIES | 3 |
| | | NUMBER OF PAGES | N |
| | | JOB INPUT SOURCE | PRINTER |
| | | POSTPROCESSING MODE | STAPLING |
| | | ··· | ··· |
| | | ··· | ··· |
| | | ··· | ··· |
| SHEET LIST | NODE 1 | SHEET NUMBER | 1 |
| | | SHEET SIZE | A4 |
| | | WEIGHT | 60gsm |
| | | SHEET TYPE | PLAIN PAPER |
| | | TRAY NUMBER | 1 |
| | | ~ | ~ |
| | | IMAGE ADDRESS | 111111111 |
| | | FOLLOWING NODE ADDRESS | aaaaa |
| | | PRECEDING NODE ADDRESS | NULL |
| | NODE 2 | SHEET NUMBER | 2 |
| | | SHEET SIZE | A5 |
| | | WEIGHT | 40gsm |
| | | SHEET TYPE | ENVELOPE |
| | | TRAY NUMBER | PI |
| | | ~ | ~ |
| | | IMAGE ADDRESS | 12345678 |
| | | FOLLOWING NODE ADDRESS | bbbbb |
| | | PRECEDING NODE ADDRESS | aaaaa |
| | ~ | ~ | ~ |
| | NODE N | SHEET NUMBER | N |
| | | SHEET SIZE | A4 |
| | | WEIGHT | 60gsm |
| | | SHEET TYPE | PLAIN PAPER |
| | | TRAY NUMBER | 1 |
| | | ~ | ~ |
| | | IMAGE ADDRESS | 55555555 |
| | | FOLLOWING NODE ADDRESS | NULL |
| | | PRECEDING NODE ADDRESS | yyyyy |

FIG.5
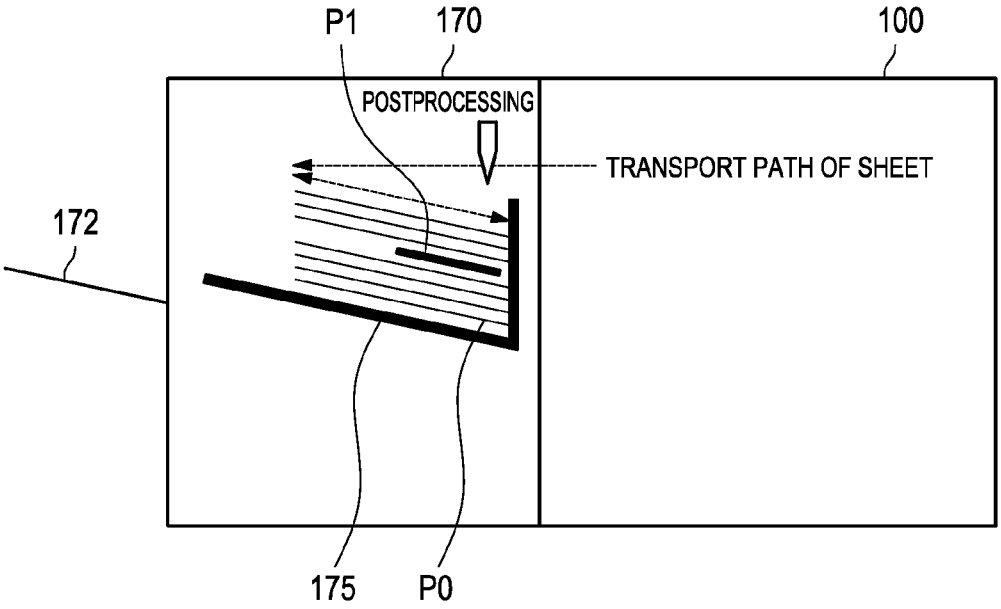
(A)
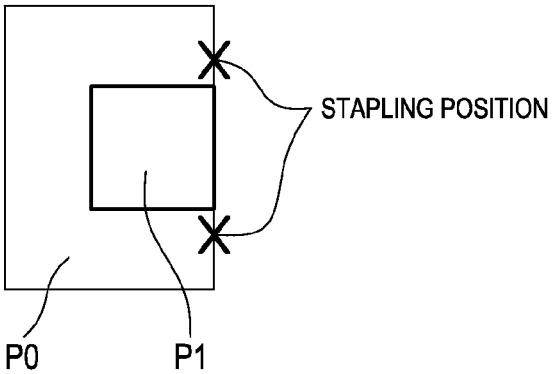
(B)

IMAGE FORMING SYSTEM HAVING FUNCTION TO PERMIT STAPLE PROCESSING FOR JOB INCLUDING SMALL SIZE SHEET BASED ON PAGE POSITION OF SMALL SIZE SHEET IN A JOB, AND IMAGE FORMING METHOD FOR THE SAME

CROSS-REFERENCE TO RELATED APPLICATION

This application is based on Japanese Patent Application No. 2012-093424 filed with Japan Patent Office on Apr. 16, 2012, the entire content of which is hereby incorporated by reference.

BACKGROUND OF THE INVENTION

1. Field of the Invention

The present invention relates to an image forming system and an image forming method which can form an image on a sheet, and can further carry out postprocessing to the sheet on which the image is formed based on a job.

2. Description of the Related Art

Image forming apparatuses for printing an image on a sheet such as a copier, a printer, a facsimile, and a multi-function machine can carry out desired postprocessing to sheets on which an image is printed. The postprocessing is usually carried out by a finisher connected on a side of a subsequent stage of the image forming apparatuses. The finishers can include a side stitching apparatus, a saddle stitching apparatus, a folding apparatus, a punching apparatus, a bookbinding apparatus, and a large-capacity stacker, and others for example.

In the image forming system constructed by at least the image forming apparatus and the finisher, for example, the printing and the postprocessing are carried out based on a job set by the image forming apparatus. A sheet size, a sheet weight, a sheet type, and contents of the postprocessing, and the like can be defined in the job setting, and a setting to use sheets different in size and type can be made in a single job.

For example, Japanese Unexamined Patent Application Publications No. 2009-234749 and No. 2009-234750 relating to a complex folding machine, a printing machine, and a complex folding method propose apparatuses which can automatically fold booklets and sheets different in size in a single booklet while a facility cost is restrained from increasing.

Moreover, Japanese Unexamined Patent Application Publication No. 2010-228835 proposes a sheet assembling apparatus which prevents sheets different in size from collapsing.

For carrying out various types of postprocessing, there are a sheet size, a sheet weight, a sheet type, and the like required for proper postprocessing, and the postprocessing can be carried out for sheets different in size or others within these ranges as disclosed in Japanese Unexamined Patent Application Publications No. 2009-234749, No. 2009-234750, and No. 2010-228835.

However, various print forms come to be required in the field of the production print (PP) and the like, though there is a need for inserting a small sheet such as an envelope in a booklet, for example, if a job set to insert a sheet small in thin sheet, an envelope, or the like which cannot, be carried out the postprocessing is executed, a conventional system carries out processing to stop the apparatus due to such a prohibition that the postprocessing cannot be carried out. If a job includes a sheet subject to the prohibition according to Japanese Unexamined Patent Application Publications No. 2009-234749, No. 2009-234750, and No. 2010-228835, the processing cannot be continued. Moreover, if a page where the postprocessing is set to off by setting per page is generated in a job where the postprocessing is set to on, a booklet is divided at a border where the postprocessing switches between on/off. Thus, there is not means for generating a booklet into which an advertisement on a thin sheet is inserted, or a booklet into which a bookmark small in size is inserted, and the like, for example.

SUMMARY OF THE INVENTION

The present invention is devised in view of the foregoing problem, and has at least one object to provide an image forming system and an image forming method which can carry out postprocessing under predetermined conditions, thereby meeting various demands in print even if a sheet which is originally prohibited to be applied is included in a job.

To achieve at least one of the above mentioned objects, an image forming system reflecting a first aspect of the present invention is an image forming apparatus including:

an image forming unit to print an image on a sheet based on a job, postprocessing unit to carry out postprocessing to the sheet based on the job, and a control unit to manage the job, and to control the print and the postprocessing, wherein the control unit can determine whether the postprocessing execution job includes an applying prohibition sheet or not, and, if a predetermined condition is satisfied in predetermined postprocessing, permits the job for the predetermined postprocessing to use the applying prohibition sheet, and the applying prohibition sheet used by a part of the job for the predetermined postprocessing is a sheet to be inserted into a bundle of applying permission sheets in thepostprocessing.

In an image forming system reflecting a second aspect of the present invention, the predetermined postprocessing relates to bundle processing.

In an image forming system reflecting a third aspect of the present invention, the predetermined postprocessing is any of stapling, bundle folding, saddle stitching, case binding, and ring binding.

In an image forming system reflecting a fourth aspect of the present invention, the applying prohibition sheet corresponds to any of a difference in sheet size from a prescribed size, a difference in sheet weight from a prescribed weight, and a difference in sheet type from a prescribed sheet type.

In an image forming system reflecting a fifth aspect of the present invention, the applying prohibition sheet or the applying permission sheet is set in the control unit for each of the postprocessing.

In an image forming system reflecting a sixth aspect of the present invention, the predetermined condition satisfies any one of a page other than first and last pages, a predetermined sheet size, a predetermined sheet type, a predetermined number of sheets, and a sheet fed from a predetermined tray.

In an image forming system reflecting a seventh aspect of the present invention, the predetermined condition satisfies any one of a predetermined sheet size, a predetermined sheet type, a predetermined number of sheets, and a sheet fed from a predetermined tray, and the predetermined sheet size is a size smaller than a body sheet size.

In an image forming system reflecting an eighth aspect of the present invention, the predetermined condition satisfies any one of a predetermined sheet size, a predetermined sheet type, a predetermined number of sheets, and a sheet fed from a predetermined tray, and the predetermined, sheet type is an envelope.

In an image forming system reflecting a ninth aspect of the present invention, the predetermined condition satisfies any one of a predetermined sheet size, a predetermined sheet type, a predetermined number of sheets, and a sheet fed from a predetermined tray, and the predetermined number of sheets is equal to or less than a set number of sheets.

In an image forming system reflecting a tenth aspect of the present invention, the predetermined condition satisfies any one of a predetermined sheet size, a predetermined sheet type, a predetermined number of sheets, and a sheet fed from a predetermined tray, and the predetermined tray is a tray set so that a sheet can be inserted.

In an image forming system reflecting an eleventh aspect of the present invention, the predetermined condition satisfies any one of a predetermined sheet size, a predetermined sheet type, a predetermined number of sheets, and a sheet fed from a predetermined tray, and the control unit can set, if the predetermined condition is satisfied in the predetermined postprocessing, whether partial use of the applying prohibition sheet is permitted or not.

In an image forming system reflecting a twelfth aspect of the present invention, the predetermined condition satisfies any one of a predetermined sheet size, a predetermined sheet type, a predetermined number of sheets, and a sheet fed from a predetermined tray, and the control unit enables setting of either one of or both of the predetermined postprocessing and the predetermined condition.

In an image forming system reflecting a thirteenth aspect of the present invention, the predetermined condition satisfies any one of a predetermined sheet size, a predetermined sheet type, a predetermined number of sheets, and a sheet fed from a predetermined tray, and the control unit determines whether or not the job includes use of an applying prohibition sheet or not when the job is set or the job is executed.

In an image forming system reflecting a fourteenth aspect of the present invention, the predetermined condition satisfies any one of a predetermined sheet size, a predetermined sheet type, a predetermined number of sheets, and a sheet fed from a predetermined tray, and if the control unit determines that the postprocessing in an applying prohibition sheet, and the predetermined postprocessing or the predetermined condition is not satisfied, the control unit stops the execution of the job for the predetermined postprocessing due to prohibition.

To achieve at least one of the above mentioned objects, an image forming method reflecting a fifteenth aspect of the present invention is an image forming method for printing an image on a sheet and applying postprocessing to the sheet based on a job, including:

determining whether the postprocessing execution job includes an applying prohibition sheet or not;

permitting, if the postprocessing execution job includes the applying prohibition sheet, and a predetermined condition is satisfied in predetermined postprocessing, the job for the predetermined postprocessing to use the applying prohibition sheet; and inserting the applying prohibition sheet used by a part: of the job for the predetermined postprocessing into a bundle of execution permission sheets in the postprocessing.

In an image forming method reflecting a sixteenth aspect of the present invention, the predetermined postprocessing relates to bundle processing.

In an image forming method reflecting a seventeenth aspect of the present invention, the predetermined postprocessing is any of stapling, bundle folding, saddle stitching, case binding, and ring binding.

In an image forming method reflecting an eighteenth aspect of the present invention, the applying prohibition sheet corresponds to any of a difference in sheet size from a prescribed size, a difference in sheet weight from a prescribed weight, and a difference in sheet type from a prescribed sheet type.

In an image forming method reflecting a nineteenth aspect of the present invention, the applying prohibition sheet or the applying permission sheet is set for each postprocessing.

In an image forming method reflecting a twentieth aspect of the present invention, the predetermined condition satisfies any of a page other than first and last pages, a predetermined sheet size, a predetermined sheet type, a predetermined number of sheets, and a sheet feeding from a predetermined tray.

In an image forming method reflecting a twenty-first aspect of the present invention, if the predetermined condition is satisfied in the predetermined postprocessing, whether partial use of the applying prohibition sheet is permitted or not can be set in advance.

In an image forming method reflecting a twenty-second aspect of the present invention, either one or both of the predetermined postprocessing and the predetermined condition can be set in advance.

In an image forming method reflecting a twenty-third aspect of the present invention, whether the job includes use of an applying prohibition sheet or not is determined when the job is set or the job is executed.

In an image forming method reflecting a twenty-fourth aspect of the present invention, if it is determined that the postprocessing includes an applying prohibition sheet, and the predetermined postprocessing or the predetermined condition is not satisfied, the execution of the job for the predetermined postprocessing is stopped due to prohibition.

BRIEF DESCRIPTION OF THE DRAWINGS

FIG. 3 is a diagram showing an overview of to node format according to the embodiment of the present invention.

FIG. 5 is a diagram showing a loaded state and a sheet overlapping state of a sheet bundle into which an applying prohibition sheet is output according to the embodiment of the present invention.

DETAILED DESCRIPTION OF THE PREFERRED EMBODIMENTS

Figure 1:
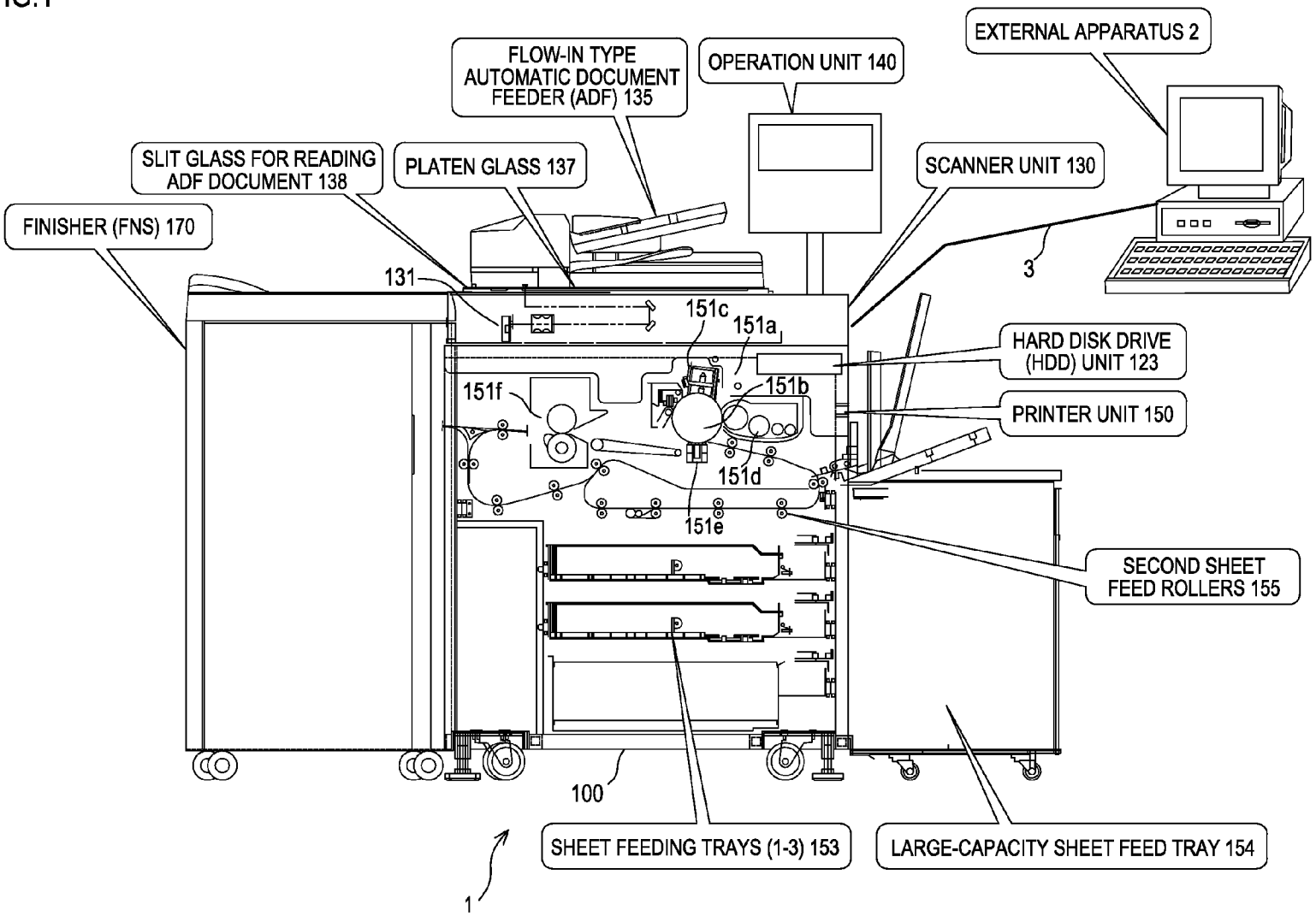
FIG. 1 is an overall diagram of an image forming system according to an embodiment of the present invention.

A description will now be given of an embodiment of an image forming system according to the present invention referring to accompanying drawings. FIG. 1 is a diagram showing an overview of a mechanical configuration of the image forming system according to the present invention.

The image forming system 1 includes an image forming apparatus 100, a large-capacity sheet feeding tray 154 connected to an former stage side of the image forming apparatus 100, and a finisher (ENS) 170 connected to a latter stage side of the image forming apparatus 100. According to the present invention, the configuration of the image forming system is not limited to this configuration, and a large-capacity sheet feeding tray which can store sheets to be inserted or the like may be connected between the image forming apparatus 100 and the finisher 170, for example.

The image forming apparatus 100 is provided with, at a top portion, a scanner unit 130 including a CCD 131 and a flow-in type automatic document feeder (ADF) 135, thereby enabling to read an image of a document through a platen glass 137 or a slit glass for reading ADF document 138.

The scanner unit 130, the flow-in type automatic document feeder (ADF) 135, the platen glass 137, the slit glass for reading ADF document 138, and the like described above constitute an image reading unit relating to the scanner unit 130.

Moreover, at the to portion of the image forming apparatus 100, an operation unit 140 constructed by a touch panel is provided at a location where the platen glass 137 is not present so as to enable operations by an operator and display of information. The operation unit 140 constructs an operation unit, and also serves as a display unit. It should be noted that the operation unit and the display unit may be independently constructed.

At a bottom portion of the image forming apparatus 100, multiple sheet feeding trays (1-3) 153 (three stages in the diagram) are provided, and, further, the large-capacity document feeding tray 154 also serving as the sheet feeding tray is arranged so as to be attached to the image forming apparatus 100. In the image forming apparatus 100, a transport path for transporting a sheet fed from the sheet feeding tray, second sheet feed rollers 155, and the like are provided, and, in the course of the transport path, an image forming unit 151 constructed by an LD unit 151*a*, a photoreceptor 151*b*, a charger 151*c*, a developing unit 151*d*, a transfer unit 151*e*, a fixing unit 151*f*, and the like is provided.

The image forming unit 151, the sheet feeding trays (1-3) 153, the large-capacity sheet feeding tray 154, the transport path, the second sheet feeding rollers 155, and the like construct a printer unit 150.

The charger 151*c*, the developing unit 151*d*, and the transfer unit 151*e* are arranged around the photoreceptor 151*b*. The charger 151*c* uniformly charges a surface of the photoreceptor 151*b* before an image is written. The 3D unit 151*a* irradiates a semiconductor laser on the photoreceptor 151*b* having the uniformly charged surface, thereby forming a latent electrostatic image on the photoreceptor 151*b*. The developing unit 151*d* develops the latent electrostatic image formed by the LD unit 151*a* on the photoreceptor 151*b* using a toner material. The development processing forms a toner image on the photoreceptor 151*b*. The transfer unit 151*e* transfers the toner image on the photoreceptor 151*b* onto a sheet transported from the sheet feeding trays (1-3) 153 or the large-capacity sheet feeding tray 154. The sheet on which the toner image is transferred is separated from the photoreceptor 151*b*, and is transported to the fixing unit 151*f*. The toner material remaining on the photoreceptor 151*b* is removed by a cleaning unit.

The fixing unit 151*f* fixes the toner image transferred to a surface of the sheet by heating the transported sheet. The sheet to which the fixing processing is applied is directly transported to the finisher (FNS) 170 provided on a side of the image forming apparatus 100 for the one-side printing.

The finisher (ENS) 170 corresponds to a postprocessing unit of the present invention. In the finisher (ENS) 170, postprocessing such as punching, stapling, and folding is carried out On the other hand, for double-side printing, the sheet after fixing is switched back, and a predetermined image is transferred by the image forming unit 151 on the other surface of the sheet. Then, the sheet on both sides of which the images are formed is transported to the finisher (FNS) 170.

The external apparatus 2 and the like are connected to the image forming system 1 via a LAN 3. On the external apparatus 2, a job directed to the image forming system 1 can be set or loaded, and the postprocessing can be also set.

Figure 2:
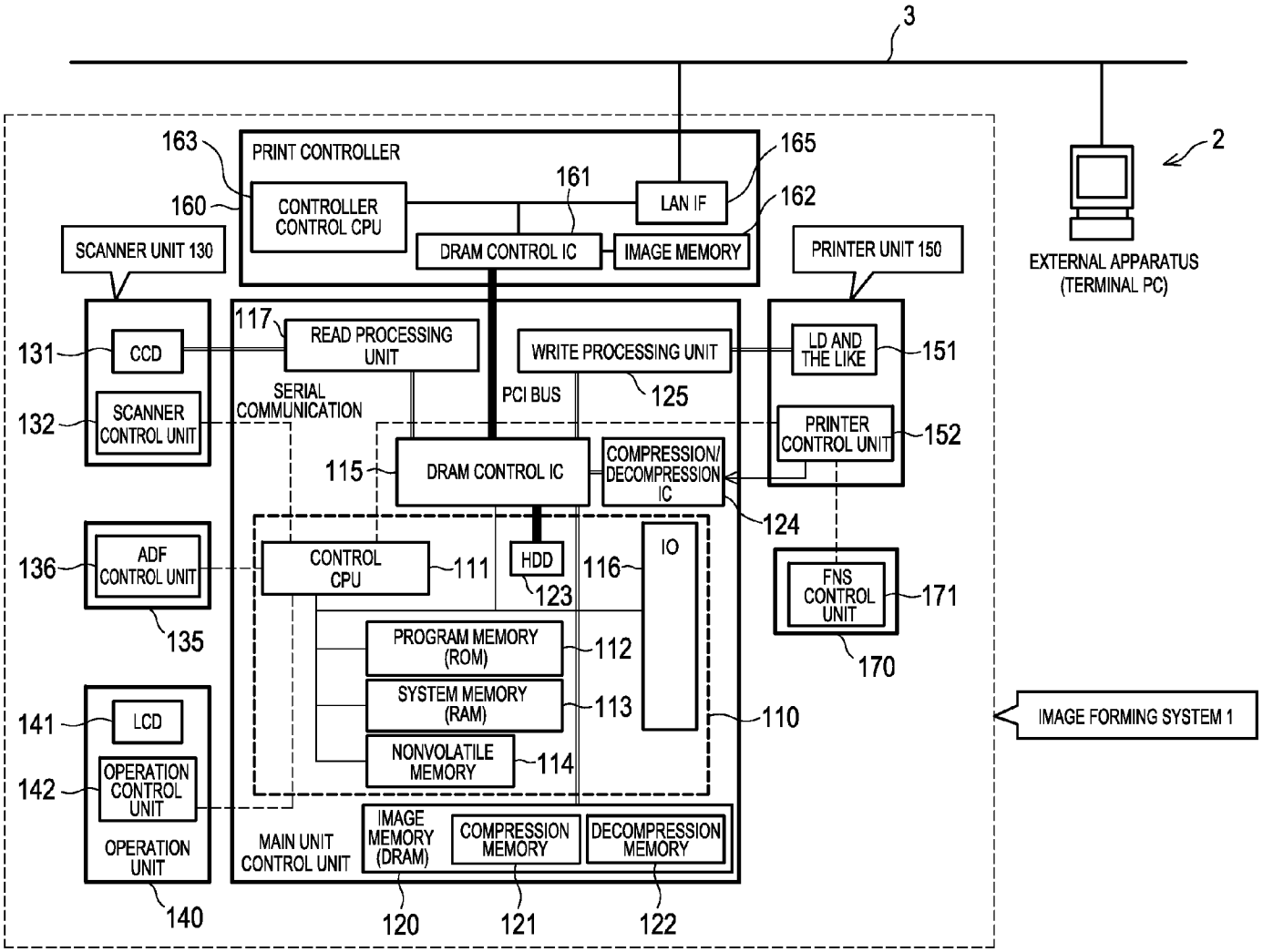
FIG. 2 is an overall block diagram of the image forming system according to the embodiment of the present invention.

FIG. 2 shows a connection between a circuit block of the image forming system 1, which is a digital multi-function machine (copier, printer, and scanner), and an external apparatus (terminal PC) 2, and is an entire block diagram of the image forming system 1. A detailed description will now be given of contents thereof.

The image forming system 1 is provided with a digital copier main unit including a control block unit 110, the scanner unit 130, the operation unit 140, and the printer unit 150, and a print controller 160 which processes image data input from the external apparatus 2 such as the terminal PC via the LAN 3, and enables transport of the image data acquired by the scanner unit 130 via the LAN 3 to the external apparatus 2.

The control block unit 110 includes a PCI bus connected to the print controller 160, and the DRAM control IC 115 is connected to the PCI bus. An image memory (DRAM) 120 composed of a compression memory 121 and a decompression memory 122 is connected to the DRAM control IC 115. The compression memory 121 is a memory for storing compressed image data, and the decompression memory 122 is a memory for temporarily storing non-compressed image data subject to print before image formation.

Moreover, to the PCI bus, the hard disk drive (HDD) unit 123 is connected, and image data acquired by the scanner unit 130, image data generated by the external apparatus 2 connected to the print controller 160, and the like are stored in the hard disk drive (HDD) unit 123.

The image data acquired by the print controller 160 and the image data stored in the hard disk drive (HDD) unit 123 are transmitted via the PCI bus to the DRAM control IC 115 in accordance with the print operation.

Moreover, the control block unit 110 is provided with a control CPU 111, and the DRAM control IC 115 is connected to the control CPU 111.

Moreover, a program memory 112 constructed by a ROM or the like, a system memory 113 constructed by a RAM, and a non-volatile memory 114 constructed by a flash memory or the like are connected to the control CPU 111. Initial print setting information on the image forming system 1, machine setting information such as process control parameters, user set values, and initial data of output setting are stored in the non-volatile memory 114, and a program according to the embodiment for operating the control CPU 111 and the like are stored in the program memory 112. The system memory 113 is used to temporarily store data, or is used as a work area when the control CPU 111 operates.

Moreover, setting data for applying permission sheets or applying prohibition sheets according to the type of postprocessing is stored in the non-volatile memory 114.

The control CPU 111 can read data in the program memory 112 and the system memory 113, and non-volatile data in the non-volatile memory 114, and can write desired data into the system memory 113 and the non-volatile memory 114. An IO unit 116 operates as an interface for transmitting/receiving information to/from respective units in the image forming system 1.

The control CPU 111 controls operations of the respective units of the image forming system 1 according to the machine setting information, the print setting information, a page interval shift setting, and the like.

The control CPU 111 can read setting information in the non-volatile memory 114, thereby determining whether or not a postprocessing execution job can be carried out on a sheet used in the job.

The non-volatile memory 114 can store types of postprocessing permitted to be applied if the postprocessing includes an applying prohibition sheet, and can store setting of predetermined conditions for permitting the application.

The control CPU 111 constructs, along with the program memory 112, the system memory 113, the non-volatile memory 114, the IO unit 116, the hard disk drive (HDD) unit 123, and the like, the control block unit 110. The control. CPU 111 constructs, along with the program memory 112, the system memory 113, and the non-volatile memory 114, a control unit according to the present invention.

The control unit carries out management control such as generation, editing, reservation, execution, deletion, and the like of a job based on image data stored in the hard disk drive (HOD) unit 123 or the image memory 120 and data relating to the job stored in the system memory 113.

The hard disk drive (HOD) unit 123 and the image memory 120 correspond to a storage unit.

The scanner unit 130 is provided with a CCD 131 for optical reading, and a scanner control unit 132 for controlling the entire scanner unit 130. The scanner control unit 132 is connected to the control CPU 111 for serial communication. Moreover, the CCD 131 is connected to a read processing unit 117 for processing image data read by the CCD 131, and the read processing unit 117 is connected to the DRAM control. IC 115 in a controllable manner.

Moreover, in order for the scanner unit 130 to read a document of multiple sheets, the scanner unit 130 includes a flow-in type automatic document feeder 135, and the flow-in type automatic document feeder 135 is provided with an ADF control unit 136 for carrying out control for the entire feeder. The ADF control unit 136 is connected to the control CPU 111 for serial communication.

The operation unit 140 serves both as a display unit and an input unit, is provided with an LCD 141 constructed by a touch panel and an operation unit control unit 142 for controlling the entire operation unit, and the operation unit control unit 142 is connected to the control CPU 111 for serial communication.

The operation unit 140 is controlled by the control CPU 111 to be able to display mechanical setting inputs such as output condition setting and operation control setting, setting inputs of sheet information (size and type) of each of the sheet feeding trays, to display setting contents, and to display desired information such as a warning and the like in the image forming system 1 by means of the LCD 41. The setting can be made per page. Moreover, the operation unit 140 enables setting of the postprocessing, and setting to permit application of the postprocessing if a postprocessing execution job includes an applying prohibition sheet.

A compression/decompression IC 124 for compressing/decompressing image data is connected to the DRAM control IC 115. A write processing unit 125 is connected to the image forming unit 151 provided with the LD 151*a* and the like of the printer unit 150, and carries out processing for write data used for an operation of the LD 151*a*.

The printer unit 150 is constructed by, in addition to the image forming unit 151, a sheet feeding unit constructed by the sheet feeding trays (1-3) 153 and the large-capacity sheet feeding tray 154, and a transport unit provided with the transport path and second sheet feed rollers 155.

Moreover, the printer unit 150 is provided with a printer control unit 152 for controlling the entire printer unit 150 (such as sheet feeding, image forming, sheet discharge, and the postprocessing), and the printer control unit 152 is connected to the control CPU 111. The printer control unit 152 controls the printer unit 150 according to a control instruction by the control CPU 111. Further, an FNS control unit 171 for controlling the entire finisher (ENS) 170 is connected to the printer control unit 152, and the finisher (ENS) 170 is controlled via the printer control unit 152.

Moreover, the DRAM control IC 161 for the print controller 160 is connected to the PCI bus to which the DRAM control IC 115 is connected as described above. The print controller 160 receives image data and the like from the external apparatus 2 connected to the LAN 3 and the like, and transmits the image data acquired by the scanner unit 130 to the external apparatus 2 connected to the LAN 3 and the like in the image forming system 1 when the image forming system 1 is used as a network printer or a network scanner.

An image memory 162 constructed by a DRAM or the like is connected to the DRAM control IC 161 in the print controller 160. Moreover, in the controller 160, the DRAM control IC 161, a controller control CPU 163 for carrying out the entire print controller 160, and a LAN interface 165 are connected to a common bus. The LAN interface 165 is connected to the LAN 3.

A description will now be given of a basic operation of the image forming system 1.

A description will be given of a procedure for accumulating image data in the image forming system 1.

First, a description is given of a case where an image is read by the scanner unit 130, thereby generating read image data in the image forming system 1. The image is optically read by the CCD 131 from a document in the scanner unit 130. On this occasion, an operation of the CCD 131 is controlled by the scanner control unit 132 which receives an instruction from the control CLU 111. The document reading can be carried out while a document is being fed by the flow-in type automatic document feeder (ADE) 135, or the document is placed on the platen glass 137.

The control CPU 111 operates according to a program, and issues a command to the scanner unit 130 based on an operation on the operation unit 140. Data processing is applied to the image read by the COD 131 by the reading processing unit 117, and image data to which data processing is applied is transmitted via the DRAM control IC 115 to the compression/decompression IC 124, and is compressed by means of a predetermined method. The compressed data is stored via the DRAM control IC 115 in the compression memory 121. Moreover, it the compressed data is to be stored in the hard disk drive (HDD) unit 123, the data once stored in the compression memory 121 is sent via the DRAM control IC 115 to the hard disk drive (HDD) unit 123.

In addition thereto, the image data is input via the LAN 3 to the image forming system 1. Image data generated by an application program or the like of the external apparatus 2, and an image data generated by another image forming system 1 can be mentioned as the image data, for example. The data is received via the LAN 3 and the LAN interface 165 by the print, controller 160, and is once stored in the image memory 162 by the DRAM control IC 161. The data stored in the image memory 162 is sent via the PCI bus to the DRAM control IC 115, and is once stored in the decompression memory 122. The data stored in the decompression memory 122 is transmitted via the DRAM control IC 115 to the compression/decompression IC 124 to undergo the compression processing, and is stored via the DRAM control IC 115 in the compression memory 121. If the data is to be stored in the hard disk drive (HDD) unit 123, the data once stored in the compression memory 121 is sent via the DRAM control IC 115 to the hard disk drive (HDD) unit 123.

When the image data is accumulated, output setting is carried out before or after the accumulation of the image data. The output setting can be carried out by an operation input by an operator while a setting screen which enables the operation input is displayed on the operation unit 140. Moreover, even if output setting items are selected in an initial setting, and the operator does not carry out the setting input, the output setting is also carried out by the initial setting.

Setting for the postprocessing can be carried out in the above setting, and the setting can be carried out per page.

When an image output is carried out in the image forming system 1, namely the image forming system 1 is used as a copier or a printer, the image data stored in the compression memory 121 is sent out via the DRAM control IC 115 to the compression/decompression IC 124, thereby decompressing data, the decompressed data is sent out to the write processing unit 125, and writing is carried out by the LD unit 151*a* on the photoreceptor 151*b* charged by the charger 151*c*. When the image data stored in the hard disk drive (HDD) unit 1231*s* used, the image data stored in the hard disk drive (HDD) unit 123 is once stored via the DRAM control IC 115 in the compression memory 121, the image data stored in the compression memory 121 is sent out via the DRAM control IC 115 to the compression/decompression IC 124, thereby decompressing the data, and the decompressed data is sent out to the write processing unit 125 as described above.

The printer control unit 152, which has received an instruction of the control CPU ill, controls respective units in the printer unit 150. A latent image written on the photoreceptor 151*b* is developed as a toner image by the developing unit 151*d* in the image forming unit 151, and the tanner image is transferred by the transfer unit 151*e* onto a sheet supplied by the transport path, and is fixed by a fixing unit 151*f*. The sheet on which the image is formed is transported via the transport path to the finisher (FNS) 170, or the sheet is turned over, an image is transferred to a rear surface, and the sheet is transported to the finisher (ENS) 170, and postprocessing is applied if the postprocessing is set, or discharged to a predetermined discharge destination if postprocessing is not set.

On the photoreceptor 151*b*, after the toner image is transferred to the sheet, remaining toner is removed by the cleaning unit.

FIG. 3 is a diagram showing an overview of a node format.

The format of the page node includes JOB data and a sheet list. A number of copies, a number of pages, a JOB input source, postprocessing mode, and the like are stored in the JOB data. In this example, stapling is set as the postprocessing mode.

Respective items such as a sheet number, a sheet size, a weight, a sheet type, a tray number, an image address, a following node address, and a preceding node address are provided for each node in the sheet list.

In this example, an envelope is set as the sheet type at a node 2, and plain paper is set in the other nodes, if sheet specifications include "size: A4 or more", "weight: 50 gsm or more", and "sheet type: other than envelope" in the stapling, for example, and the type and the weight of the second sheet are respectively the envelope and 40 gsm, it is determined that the stapling is not possible, and the control CPU 111 stops the apparatus before the second sheet is fed due to the prohibition. In the above-described example, the envelope is set as the applying prohibition sheet. However, if predetermined conditions are satisfied even in this case according to this embodiment, the apparatus is not stopped due to the prohibition, and the application of the postprocessing is enabled.

Figure 4:
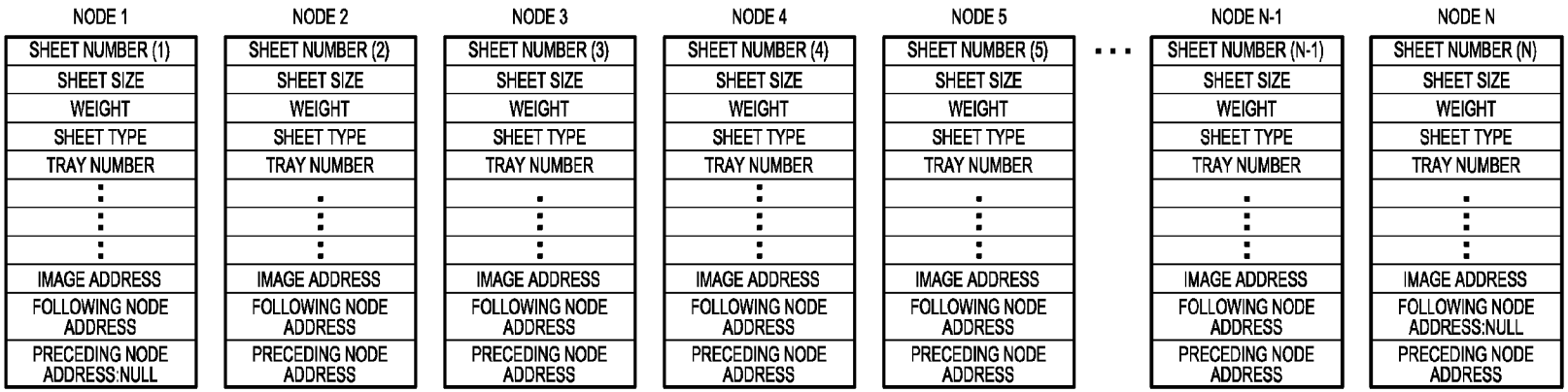
FIG. 4 is a diagram showing an image of a sheet list according to the embodiment of the present invention.

FIG. 4 shows an image of the sheet list for respective page nodes. The sheet list for respective page nodes includes items such as the sheet size, the weight, the sheet type, and the tray number as shown in FIG. 4, and the control CPU 111 determines whether or not an applying prohibition sheet in the postprocessing exists for each sheet number.

FIG. 5(A) shows a state where the stop due to the prohibition is not carried out for a sheet P1 which cannot be stapled conventionally, the sheet P1 is transported to the finisher (FNS) 170, the sheet P1 small in size is inserted between other sheets P0, and the sheets are piled as a booklet on a piling unit 175. The booklet can be discharged into a booklet discharge opening 172 of the finisher (FNS) 170 while the sheet P1 remains as inserted in the booklet.

The inserted sheet P1 is too small to be stapled, and cannot be arranged to a stapling position as shown in FIG. 5(B). However, the envelope is directly inserted in the sheet bundle, and the sheet bundle can thus be provided as a sheet bundle into which an envelope and the like are inserted according to this embodiment.

Figure 6:
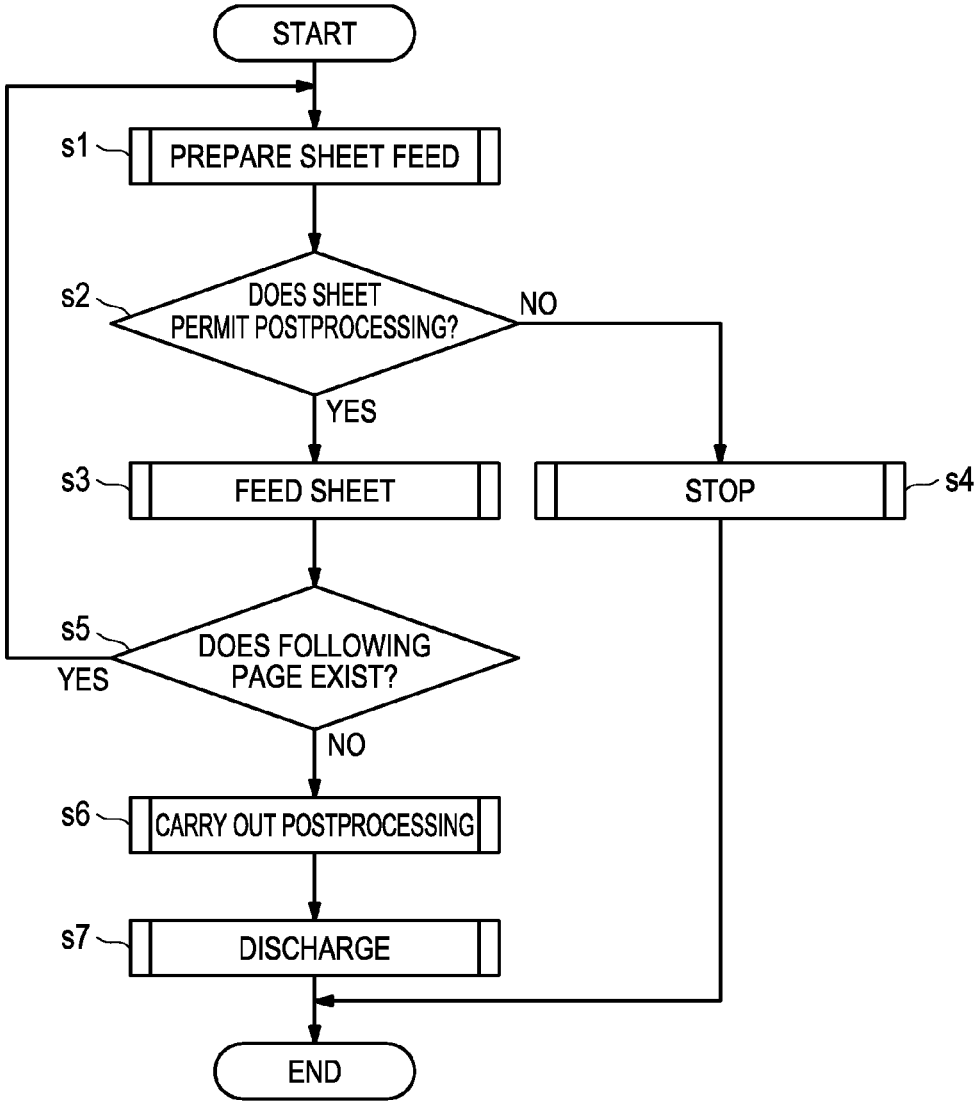
FIG. 6 is a flowchart showing a processing procedure of a conventional postprocessing execution job including an applying prohibition sheet.

A description will now be given of a procedure for processing by determining whether or not a sheet to which the postprocessing can be applied exists referring to a flowchart in FIG. 6.

As a job starts, a sheet feed is prepared for each page (Step s1), and it is determined whether or not the page is a sheet to which the postprocessing can be applied in a postprocessing execution job (Step s2). If the page is a sheet to which the postprocessing can be applied (Yes in Step s2), the sheet is fed (Step s3), it is determined whether a following page exists or not (Step s5), if a following page exists, the processing proceeds to Step s1 (Yes in Step s5), and the same processing is carried. If it is determined that the page is not a sheet to which the postprocessing can be applied in Step s2 (No in Step s2), the apparatus is stopped (Step s4), and the processing is finished.

If it is determined that a following page does not exist in Step s5 (No in Step s5), the postprocessing is carried out (Step s6), a sheet bundle is discharged (Step s7), and the processing is finished.

Figure 7:
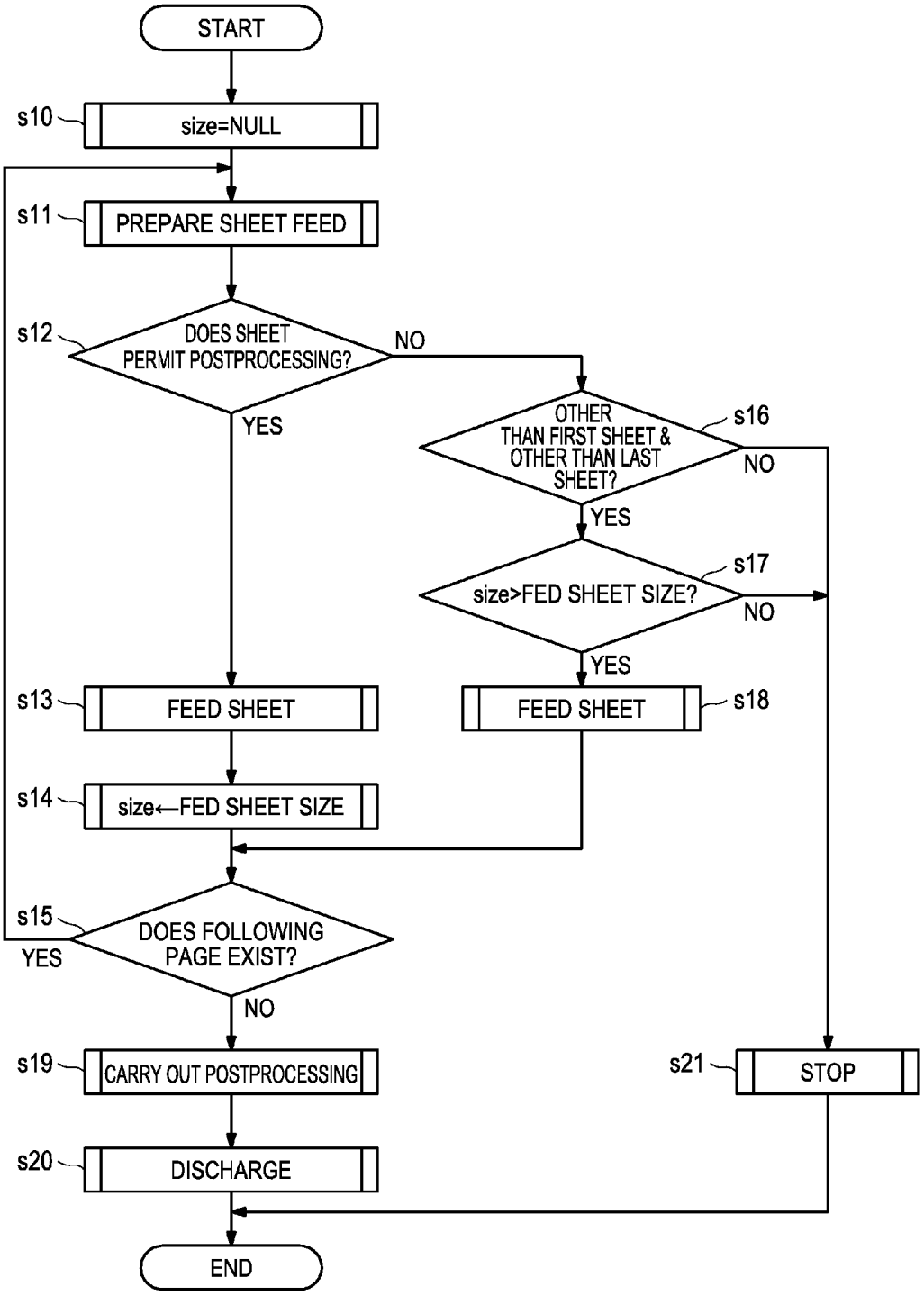
FIG. 7 is a flowchart showing a procedure for outputting a sheet which is set as an applying prohibition sheet due to a small size in a postprocessing execution job according to the embodiment of the present invention.

A description will now be given of a processing procedure for feeding a sheet to which the postprocessing cannot be applied, and outputting the sheet if predetermined conditions are satisfied in a postprocessing execution job according to this embodiment referring to a flowchart in FIG. 7.

As a job starts, NULL data is set to a variable, size, which is sheet size data (Step s10).

A sheet feed is prepared for each page (Step s11), and it is determined whether or not the page is a sheet to which the postprocessing can be applied in the postprocessing execution job (Step s12). If the page is a sheet to which the postprocessing can be applied (Yes in Step s12), the sheet is fed (Step s11), the sheet size of the fed sheet is set to the variable, size (Step s14), and it is determined whether a following page exists or not (Step s15) if there is a following page, the procedure proceeds Step s11, and carries out the same processing (Yes in Step s15).

If the page is not a sheet to which the postprocessing can be applied in Step s12 (No in Step 312), it is determined whether or not the page is a sheet other than the first sheet and other than the last sheet (Step s16). If the page is other than the first sheet and the last sheet (Yes in Step s16), it is determined whether or not the sheet size to be fed is less than the size set to the variable, size (Step s17). If the fed sheet size is less than the size set to the variable, size (Yes in Step s17), since it is determined that the postprocessing prohibition is caused by the small sheet size, the sheet feed is carried out so as to permit the output of the sheet (step s18), and the procedure proceeds to the step to determine whether a following page exists or not (Step s15). If there is a following page, the procedure proceeds to Step d1, and the same processing is carried out (Yes in Step s15)

If the page does not correspond to a sheet other than the first sheet and the last sheet in Step s16, and is thus the first sheet or the last sheet (No in Step s16), the apparatus is stopped (Step s21), and the processing is finished.

Moreover, if the fed sheet size is not less than the size set by the variable, size, in Step s17 (No in Step s17), it is determined that the postprocessing prohibition is not caused by the small sheet size, the apparatus is stopped (Step s21), and the processing is finished.

If the page does not have a following page (No in Step s15), the postprocessing is carried out (Step s19), a sheet bundle to which the postprocessing is applied (Step s20), and the processing is finished.

The above-described procedure can output a sheet small in size (applying prohibition sheet) to which the postprocessing is prohibited from being applied between sheets to which the postprocessing can be applied.

As a result, a booklet including an inserted sheet such as an advertisement and a book mark can be generated in online processing by a PP (Production Print) machine and the like, thereby extending a range supported by the PP machine.

Figure 8:
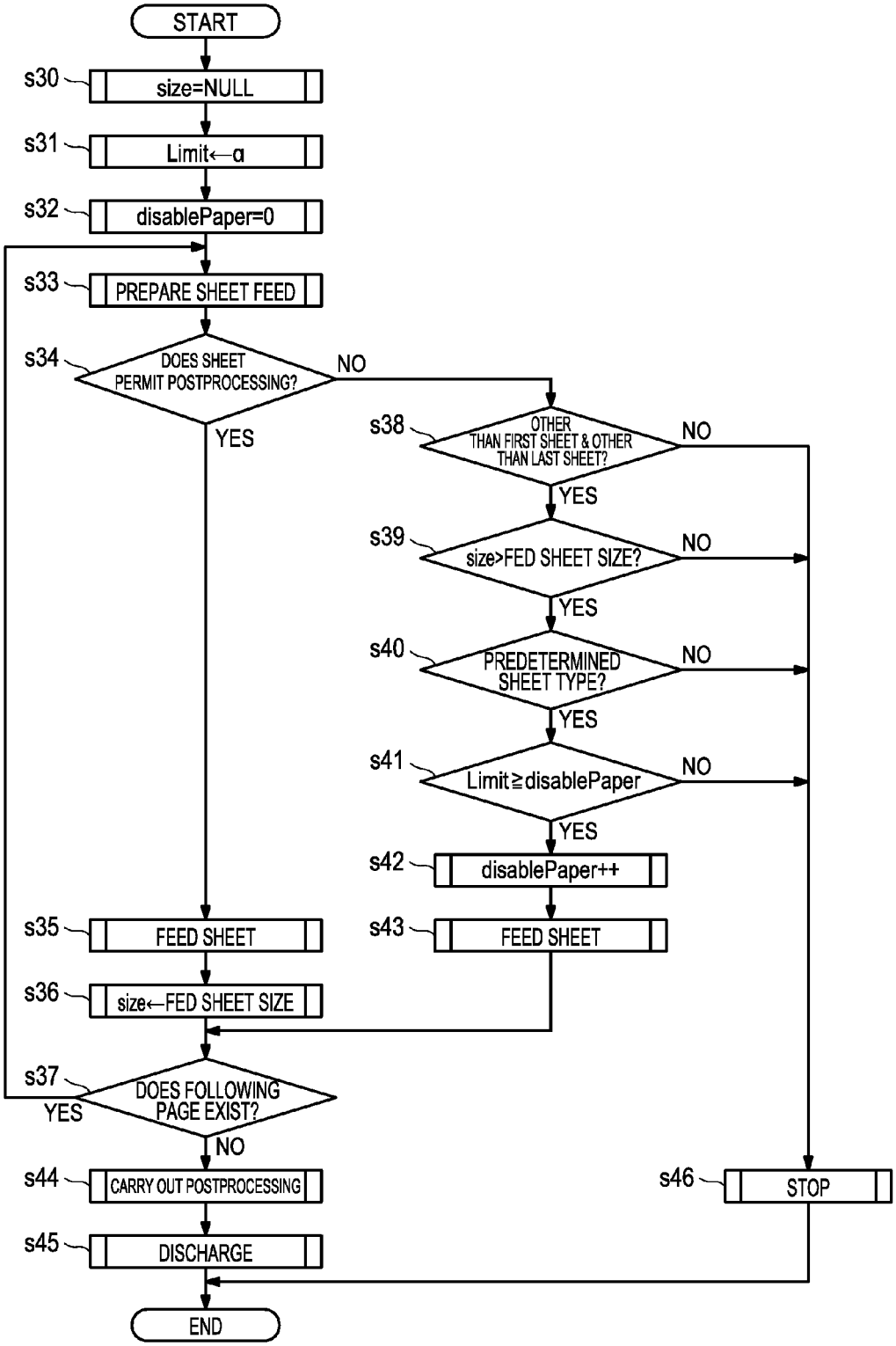
FIG. 8 is a flowchart showing a procedure for outputting a sheet which is set as an applying prohibition sheet due to a small size in a postprocessing execution job under conditions of a predetermined sheet type and a number of sheets equal to or less than a predetermined number of sheets according to the embodiment of the present invention.

A description will now be given of a procedure for permitting an output if sheets to which application of the postprocessing is prohibited satisfy such conditions that the type of sheets is a predetermined type, and the number of the sheets is equal to or less than a predetermined number referring to a flowchart in FIG. 8.

As the job starts, NULL data is set to the variable, size (Step s30), a is set to a variable, Limit (Step s31), and 0 is set to a variable, disablePaper (Step s32). The variable, Limit, is the maximum number of applying prohibition sheets which can be used, and applying prohibition sheets the number of which exceeds the maximum number cannot be used. The variable, Limit, corresponds to the predetermined number as described. The variable, disablePaper, is a used number of the applying prohibition sheets.

After the variables are set, a sheet feed is prepared for each page (Step s33), and it is determined whether or not the page is sheet to which the postprocessing can be applied in a postprocessing execution job (Step s34). If the page is a sheet to which the postprocessing can be applied (Yes: in Step s34), the sheet is fed (Step s35), the sheet size of the fed sheet is set to the variable, size (Step s36), and it is determined whether a following page exists or not (Step s37). If there is a following page, the procedure proceeds to Step s33, and the same processing is carried out (Yes in Step s37).

If it is determined that the page is not a sheet to which the postprocessing can be applied in Step s34 (No in Step s34), it is determined whether or not the page is a sheet other than the first sheet and the last sheet (Step s38). If the page is other than the first sheet and the last sheet (Yes in Step s38), it is determined whether or not the sheet size to be fed is less than the size set to the variable, size (Step s39).

If the page does not correspond to a sheet other than the first sheet and the last sheet, and is thus the first sheet or the last sheet (No in Step s38), the apparatus is stopped (Step s46), and the processing is finished.

If the page is other than the first sheet and the last sheet, and the sheet size to be fed is less than the size set to the variable, size (Yes in Step s39), it is determined that the postprocessing prohibition is caused by the small sheet size, and then it is determined whether or not the page is a predetermined sheet type which enables output of the applying prohibition sheet (Step s40).

If the sheet size to be fed is not less than the size set to the variable, size (No in Step s38), the apparatus is stopped (Step s46), and the processing is finished.

If the sheet is the predetermined sheet type (Yes in Step s40), it is determined whether the variable, disablePaper is equal to or less than the variable, Limit, or not (Step s41).

If the variable, disablePaper, is equal to or less than the variable, Limit (Yes in Step s41), one is added to the variable, disablePaper (Step s42), and if the variable, disablePaper, is not equal to or less than the variable, Limit (No in Step s41), the apparatus is stopped (Step s46), and the processing is finished.

After one is added to the variable, disablePaper, in Step s42, the paper feed is carried out (Step s43), and the procedure proceed to a step to determine whether a following page exists or not (Step s17). If there is a following page, the procedure proceeds to Step s33, and the same processing is carried out (Yes in Step s37).

If the page does not have a following page in Step s37 (No in Step s37), the procedure carries out the postprocessing (Step s44) a sheet bundle to which the postprocessing is applied is discharged (Step s45), and the processing is finished.

The above-described procedure can output sheets small in size (applying prohibition sheet) to which the postprocessing is prohibited from being applied, and the number of which is less than the predetermined number of sheets between sheets to which the postprocessing can be applied.

Though the present invention is described based on the embodiment, the present invention is not limited to the description of the embodiment, and may be properly modified as long as the modification does not depart from the scope of the present invention.

What is claimed is:

1. An image forming system comprising:

an image forming unit to print an image on a sheet based on a job;

a postprocessing unit to carry out staple processing based on the job; and a control unit to manage the job, and to control the image forming unit and the and the postprocessing unit;

wherein the control unit determines whether the job includes a small size sheet which cannot be positioned at a stapling position in the stapling processing, and if control unit determines that the small size sheet is included in the job, the control unit determines whether a page of the small size sheet in the job is a page other than a first page or a last page of the job, wherein if the control unit determines that the page of the small size sheet is a page other than the first page or the last page of the job, the control unit permits the stapling processing of the job to be performed by the postprocessing unit, and wherein if the control unit determines that the page of the small size sheet is the first page or the last page of the job, the control unit prohibits the stapling processing of the job from being performed by the postprocessing unit.

2. The image forming system according to claim 1, wherein the small size sheet is an envelope.

3. The image forming system according to claim 1, wherein the control unit permits the staple processing to be performed if a number of small size sheets is equal to or less than a set number of sheets, and the control unit prohibits the staple processing from being performed if the number of small size sheets is greater than the set number of sheets.

4. An image forming method for an image forming system comprising an image forming unit and a postprocessing unit, the method comprising:

printing, with the image forming unit, an image on a sheet based on a job;

carrying out, with the postprocessing unit, staple processing based on the job;

determining whether the job includes a small size sheet which cannot be positioned at a stapling position in the stapling processing, and if it is determined that the small size sheet is included in the job, determining whether a page of the small size sheet in the job is a page other than a first page or a last page of the job;

if it is determined that the page of the small size sheet is a page other than the first page or the last page of the job, permitting the stapling processing of the job to be performed by the postprocessing unit; and if it is determined that the page of the small size sheet is the first page or the last page of the job, prohibiting the stapling processing of the job from being performed by the postprocessing unit.

5. The image forming method according to claim 4, wherein the small size sheet is an envelope.

6. The image forming method according to claim 4, further comprising permitting the staple processing to be performed if a number of small size sheets is equal to or less than a set number of sheets, and prohibiting the staple processing from being performed if the number of small size sheets is greater than the set number of sheets.

* * * * *